US010022955B2

(12) United States Patent
Saito et al.

(10) Patent No.: US 10,022,955 B2
(45) Date of Patent: Jul. 17, 2018

(54) INTERMEDIATE TRANSFER MEMBER AND IMAGE FORMING METHOD

(71) Applicant: CANON KABUSHIKI KAISHA, Tokyo (JP)

(72) Inventors: Yoshikazu Saito, Inagi (JP); Mitsutoshi Noguchi, Kawaguchi (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/628,497

(22) Filed: Jun. 20, 2017

(65) Prior Publication Data

US 2017/0291409 A1 Oct. 12, 2017

Related U.S. Application Data

(63) Continuation of application No. 14/932,808, filed on Nov. 4, 2015, now Pat. No. 9,707,750.

(30) Foreign Application Priority Data

Nov. 6, 2014 (JP) ..... 2014-226065

(51) Int. Cl.
*B41J 2/005* (2006.01)

(52) U.S. Cl.
CPC ..... *B41J 2/0057* (2013.01)

(58) Field of Classification Search
CPC ..... B41J 2/0057; B41J 2002/012
USPC ..... 347/103
See application file for complete search history.

(56) References Cited

U.S. PATENT DOCUMENTS

2003/0098906 A1* 5/2003 Randen ..... B41M 3/12 347/103
2009/0080949 A1* 3/2009 Yamanobe ..... B41J 2/01 399/308

* cited by examiner

*Primary Examiner* — Huan Tran
*Assistant Examiner* — Alexander D Shenderov
(74) *Attorney, Agent, or Firm* — Canon U.S.A., Inc. IP Division

(57) ABSTRACT

There is provided an intermediate transfer member used in an image forming method including applying a treatment liquid onto an intermediate transfer member, forming an intermediate image by applying an ink onto the intermediate transfer member coated with the treatment liquid so as to form dots having an average diameter of R, and transferring the intermediate image to a recording medium. The intermediate transfer member includes a surface having recessed portions therein. Each recessed portion allows a circle having a diameter of less than the average diameter R of the ink to be present therein. The surface of the intermediate transfer member has a projected area $S_1$ and an actual surface area $S_2$ satisfying the relationship $1.1 \leq S_2/S_1 \leq 5$.

9 Claims, 5 Drawing Sheets

INTERMEDIATE TRANSFER MEMBER AND IMAGE FORMING METHOD

BACKGROUND OF THE INVENTION

Field of the Invention

The present application relates to an intermediate transfer member and an image forming method.

Description of the Related Art

A variety of printed articles are produced in smaller lots in shorter delivery times. An ink jet recording method and apparatuses using the same are expected to be a suitable technique for responding to such market demands. In the ink jet recording method, however, the ink jet recording head (hereinafter referred to as recording head) may be broken by contact with the recording medium, or may be degraded in ejection stability due to paper dust or the like produced from the recording medium. In order to overcome these problems, there have been devised a variety of transfer ink jet recording methods that are performed by forming an intermediate image on an intermediate transfer member with a recording head, and transferring the intermediate image to a desired recording medium to form a final image. Japanese Patent Laid-Open No. 59-225958 discloses an ink jet printer that forms an intermediate image on a drum with a dye ink and then transfers the intermediate image to a recording medium.

It is desired from the viewpoint of image transfer efficiency that the intermediate transfer member used in such a transfer ink jet recording method have a surface having a low surface free energy. Unfortunately, if an intermediate image is formed on a surface having a low surface free energy, ink dots are attracted or mixed to each other by surface tension. This can cause the degradation of image quality. There have been devised many methods of applying a treatment liquid for reducing the fluidity of ink onto the intermediate transfer member before forming an intermediate image. In these methods, the treatment liquid previously applied to the surface of the intermediate transfer member reacts with the ink to reduce the fluidity of the ink, thereby keeping the resulting intermediate image in a good condition. Even if such a technique is used, however, an intermediate transfer member having a low surface energy is likely to reject the treatment liquid or cause similar phenomena, consequently degrading the quality of the subsequently formed intermediate image. In general, this tends to occur more frequently when the intermediate transfer member has a smooth surface with a small surface roughness. Accordingly, Japanese Patent Laid-Open No. 2009-078391 discloses that such a phenomenon is prevented by forming a fine uneven pattern in the surface of the intermediate transfer member.

SUMMARY OF THE INVENTION

According to an aspect of the disclosure, there is provided an intermediate transfer member used in an image forming method including applying a treatment liquid onto an intermediate transfer member, forming an intermediate image by applying an ink onto the intermediate transfer member coated with the treatment liquid so as to form dots having an average diameter of R, and transferring the intermediate image to a recording medium. The intermediate transfer member includes a surface capable of receiving the treatment liquid and the ink. The surface has a plurality of discrete recessed portions, each allowing a circle having a diameter of less than R to be present therein when viewed from above. The surface has a projected area $S_1$ and an actual surface area $S_2$ satisfying the relationship $1.1 \leq S_2/S_1 \leq 5$.

According to another aspect of the disclosure, an image forming method is provided which includes applying a treatment liquid onto the above-described intermediate transfer member, forming an intermediate image by applying an ink onto the intermediate transfer member coated with the treatment liquid so as to form dots having an average diameter of R, and transferring the intermediate image to a recording medium.

The intermediate transfer member and the image forming method can suppress the degradation of intermediate image quality resulting from the expansion of a defect in the coating of the treatment liquid and thus can enable high-quality images to be formed.

Further features of the present invention will become apparent from the following description of exemplary embodiments with reference to the attached drawings.

DESCRIPTION OF THE EMBODIMENTS

Even in the case of using an intermediate transfer member having a surface in which a fine uneven pattern is formed as disclosed in Japanese Patent Laid-Open No. 2009-078391, if the uneven pattern has a defect therein or foreign matter such as dust is deposited, the treatment liquid can be rejected from such a portion. Also, if the coating of the treatment liquid spread over the surface of the intermediate transfer member has a defect caused by such rejection, the three-phase contact line (the boundary of intermediate transfer member, treatment liquid, and air) is formed in the defect of the coating, and the boundary can migrate due to the surface tension of the treatment liquid. In this instance, the defect in the coating expands gradually (the exposed portion of the surface of the intermediate transfer member becomes larger) with time. In the exposed portion of the surface of the intermediate transfer member, the treatment liquid does not come into contact with the ink applied to the surface in a subsequent step, and therefore cannot reduce the fluidity of the ink. Consequently, the quality of the resulting intermediate image is degraded.

Accordingly, the present disclosure provides an intermediate transfer member that can suppress the degradation of intermediate image quality resulting from the expansion of a defect in the coating of the treatment liquid and thus can enable high-quality images to be formed, and an image forming method using the intermediate transfer member.

In the image forming method disclosed herein, a treatment liquid is applied onto an intermediate transfer member, and then, an intermediate image is formed by applying an ink onto the intermediate transfer member coated with the treatment liquid so as to form dots having an average diameter of R. Subsequently, the intermediate image is transferred to a recording medium. The surface of the intermediate transfer member that will receive the treatment liquid and the ink has a plurality of discrete recessed portions therein. Each of the recessed portions allows a circle having a diameter of less than R to be present therein when viewed from above. The projected area $S_1$ and actual surface area $S_2$ of the intermediate transfer member satisfy the relationship $1.1 \leq S_2/S_1 \leq 5$.

The intermediate transfer member disclosed herein is intended for use in the above-described image forming method. Exemplary embodiments of the image forming method and the intermediate transfer member will now be described.

Image Forming Apparatus

Figure 1:
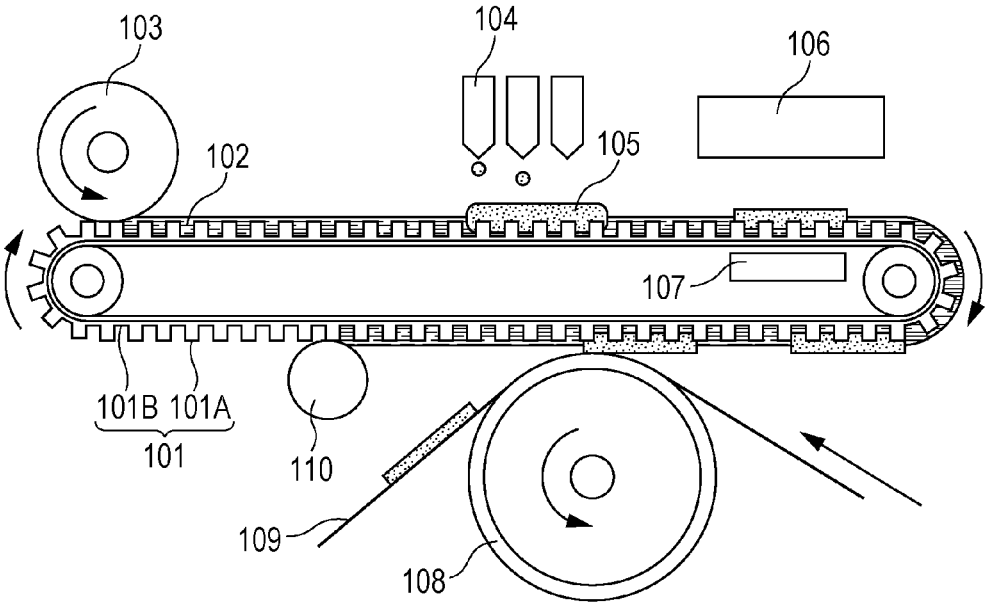
FIG. 1 is a schematic view of an image forming apparatus used in an image forming method according to an embodiment of the subject matter disclosed herein.

FIG. 1 is a schematic view illustrating the structure of an image forming apparatus used in the image forming method according to an embodiment disclosed herein. In FIG. 1, an intermediate transfer member 101 includes a support member in a rotatable endless belt form, and a surface member on the outer periphery of the support member. The surface 101A of the surface member is divided into a plurality of discrete recessed portions 101B by protruding portions. FIG. 1 does not show the boundary between the support member and the surface member. The intermediate transfer member 101 is rotated in the direction indicated by the corresponding arrows, and mechanisms around the intermediate transfer member are operated in synchronization with the rotation of the intermediate transfer member. The intermediate transfer member 101 may take any shape as long as the surface 101A thereof can come into contact with the recording medium 109, and may have a shape adapted to the image forming apparatus used or to the manner of transfer to the recording medium. For example, an intermediate transfer member in a roller or drum form may be advantageous. The support member in a belt-like endless web form or a drum form enables the intermediate transfer member to be continuously and repetitively used. This is very advantageous in terms of productivity.

Image Forming Method

The image forming method disclosed herein will be roughly illustrated below with reference to FIG. 1. First, as an image supplying device (not shown) transmits image data to the image forming apparatus for image formation, an ink jet recording head 104 processes the image data as required for image formation. Then, the intermediate transfer member 101 starts rotating. Subsequently, a roll coater 103 applies a treatment liquid 102 for reducing the fluidity of ink to the surface of the intermediate transfer member 101. Any known coating device, such as a spray coater or a bar coater, may be used for applying the treatment liquid 102, instead of the roll coater. The treatment liquid 102 applied to the surface of the intermediate transfer member 101 penetrates the fine recessed portions 101B in the surface of the intermediate transfer member 101 and thus spreads to form a coating film over the surface of the intermediate transfer member 101. The state of the spreading treatment liquid 102 can be observed through an optical microscope or the like. The amount of the treatment liquid 102 applied to the intermediate transfer member 101 is desirably in the range of 0.05 g/m$^2$ to 5.0 g/m$^2$. By applying 0.05 g/m$^2$ or more of the treatment liquid, the fluidity of ink can be satisfactorily reduced. In addition, when the amount of the applied treatment liquid is 5.0 g/m$^2$ or less, an excess of the treatment liquid does not come out or overflow from the recessed portions 101B. Accordingly messy images or transfer failure is prevented.

In the following step, an intermediate image 105 is formed by selectively applying an image-forming ink to the surface of the intermediate transfer member 101 coated with the treatment liquid 102, using an ink jet recording head 104. In this operation, the ink is applied so as to form dots having a predetermined average diameter R. The average diameter R is desirably, but not limited to, 1 μm or more from the viewpoint of allowing the ink jet recording head to be controlled so as to accurately apply ink to appropriate positions. The ink applied to the intermediate transfer member 101 comes into contact with the treatment liquid 102 at the surface of the intermediate transfer member 101, thereby bringing about a chemical and/or physical reaction to reduce the fluidity thereof. Consequently, the phenomenon of attracting ink dots each other or mixing ink dots with each other can be reduced.

In the next step, the liquid component is removed from the intermediate image formed on the intermediate transfer member 101. This step prevents an excess of the liquid component in the intermediate image from coming out or overflowing during transfer and thus prevents messy images and transfer failure. For removing the liquid component from the intermediate image, any of the known methods may be used. For example, the liquid component may be removed by heating the intermediate image, blowing low-humidity air on the intermediate image, reducing pressure, bringing an absorber into contact with the intermediate image, or a combination of these methods. Natural drying may also be performed. The image forming apparatus shown in FIG. 1 is provided with a blower 106 so as to oppose the surface of the intermediate transfer member 101 and a heater (heating device) 107 for heating the intermediate transfer member 101 from the rear side thereof. In this instance, the liquid component is removed by heating the intermediate image with the heater 107 simultaneously with blowing air on the intermediate image from the blower 106.

Subsequently, in the next step, a recording medium 109 is pressed against the intermediate transfer member 101 to transfer the intermediate image to the recording medium 109. In the image forming apparatus shown in FIG. 1, a pressure roller (pressing member) 108 presses the recording medium 109 against the intermediate transfer member 101, thus transferring the intermediate image to the recording medium 109. For this transfer operation, the pressure roller 108 and the intermediate transfer member 101 may be heated to increase the performance of transferring the intermediate image to the recording medium 109. In this instance, the pressure roller, the intermediate transfer member, and the like may be heated to a temperature in the range of 40° C. to 200° C. As long as the heating is performed in this range, degradation of ink constituents and damage to the intermediate transfer member 101 can be minimized.

If the intermediate transfer member is consecutively and repeatedly used from the viewpoint of productivity, the surface of the intermediate transfer member 101 may be cleaned to restore it before subsequent use. For cleaning for restoring, any of the known methods may be suitably used. For example, the surface of the intermediate transfer member may be cleaned by being showered with a cleaning liquid, being wiped with a wet Molton roller in contact therewith, or being brought into contact with the surface of a cleaning liquid. Alternatively, a wiper blade may be used for removing a residue, or an energy may be applied. Any method is useful. Some of these techniques may be combined. The image forming apparatus shown in FIG. 1 is provided with a Molton roller 110 so as to remove the ink component and paper dust remaining on the surface of the belt-like intermediate transfer member 101 after transfer.

The image data transmitted from the image supplying device are thus processed, and the process of image forming is completed. The recording medium to which the image has been transferred may be pressed with a fixing roller to increase the smoothness of the surface in an additional step. The fixing roller may be heated to impart a fastness to the resulting image.

The main members and materials used in the image forming method of the present embodiment will now be described in detail.

Intermediate Transfer Member

FIGS. 2A to 2D show patterns of recessed portions formed in the surface of the intermediate transfer member according to the present disclosure. More specifically, FIGS. 2A to 2D are each a schematic view illustrating the treatment liquid, a part of the ink receiving side of the intermediate transfer member 200 (designated by 101 in FIG. 1) according an embodiment, and the section taken along line A-A' in the corresponding figure. As shown in FIGS. 2A to 2D, the intermediate transfer member 200 of each embodiment has a plurality of recessed portions 201 formed in the depth direction in the surface 202 thereof. The surface 202 is defined by the upper end surfaces of protruding portions separating the recessed portions 201 from each other and is the outermost surface that will receive the treatment liquid and ink. Each recessed portion 201 has an opening (defined by the shape of the recessed portion 201 when viewed from above) 203 that is flush with the surface 202. In FIG. 2A to 2D, a large number of recessed portions are formed so as to repeat the same recess-protrusion structure in the surface to receive the treatment liquid and ink of the intermediate transfer member.

The surface 202 used herein refers to the faces in the recessed portions at the level of 10% or less of the depth D of the recessed portions and the surface between the recessed portions.

In plan view, the opening 203 of each recessed portion allows an imaginary circle having a diameter of less than the average diameter R of the ink to be present therein, and the surface of the intermediate transfer member has a projected area $S_1$ and an actual surface area $S_2$ satisfying the relationship $1.1 \leq S_2/S_1 \leq 5$. If the coating film of the treatment liquid applied on the intermediate transfer member has a defect, the intermediate transfer member 101 having such recessed portions therein suppresses the expansion of the defect. The reason of this will be described below.

(1) The projection area $S_1$ and actual surface area $S_2$ of the intermediate transfer member satisfy the relationship $1.1 \leq S_2/S_1 \leq 5$. When this relationship holds true, the surface roughness of the intermediate transfer member can be appropriate and allows the treatment liquid to spread to form a coating film over the surface of the intermediate member.

Figure 4A:
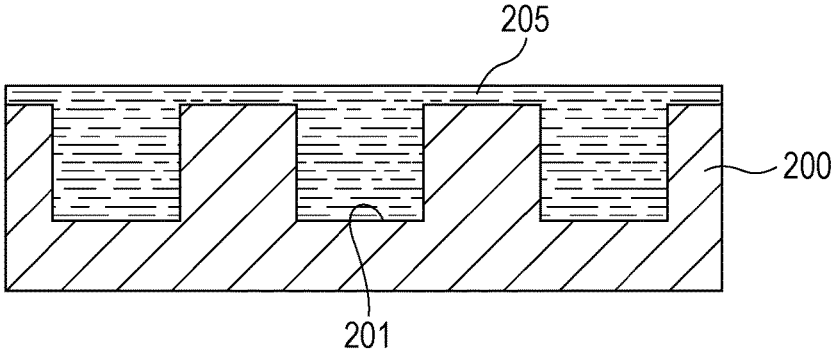
FIGS. 4A to 4C are representations illustrating the advantages of one or more embodiments of the present disclosure.
Figure 4B:
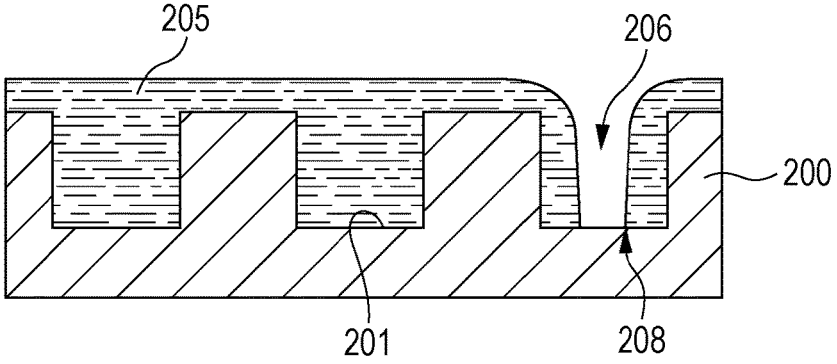
Figure 4C:
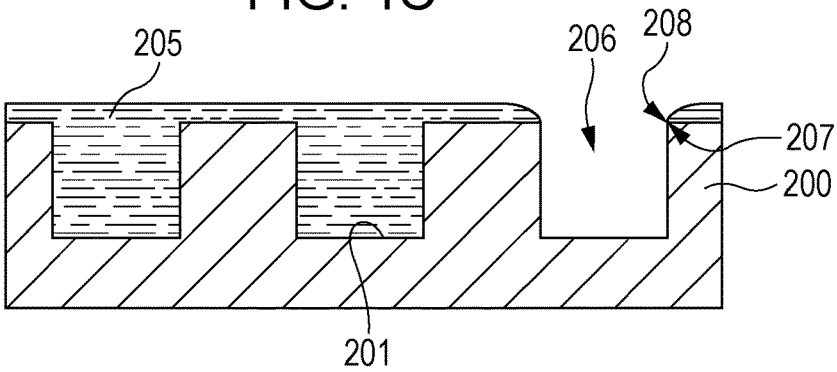

(2) If the coating film of the treatment liquid has a defect, the three-phase contact line (the boundary of intermediate transfer member, treatment liquid, and air) is formed in the defect of the coating film. The boundary can migrate due to the surface tension of the treatment liquid, and thus the defect can expand. This is more likely to occur particularly on the surface of an intermediate transfer member made of a material having a low surface free energy. Such a surface tends to repel the treatment liquid. If a solid surface has a small step or the like, however, an edge of the step can pin (fix) the migrating three-phase contact line. In the intermediate transfer member 200 of the embodiments described herein, accordingly, an edge of the opening 203 of the recessed portion 201 pins the three-phase contact line even though a defect is formed in the coating film of the treatment liquid within any one of the recessed portions 201. Since the defect formed in the coating film within a recessed portion 201 is surrounded by the wall defining the opening 203, the expansion of the defect is stopped when the defect has reached the wall of the opening 203. FIGS. 4A to 4C are schematic representations illustrating the effect of the surface structure of the intermediate transfer member to suppress the expansion of a defect in the coating film. The treatment liquid 205 applied to the surface of the intermediate transfer member 200 fills the recessed portions 201 and covers the surface of the intermediate transfer member 200, thus forming a coating film of the treatment liquid, as shown in FIG. 4A. If a defect 206 is formed in the coating within any one of the recessed portions 201, as shown in FIG. 4B, the three-phase contact line 208 migrates, and the defect is thus expanded. Finally, the three-phase contact line 208 is pinned at the edge 207 of the recessed portion 201, and thus the expansion of the defect 206 is stopped, as shown in FIG. 4C. Thus, the recessed portions 201 enable the area of the defect in the coating film to be smaller than or equal to the area of the opening when viewed from above.

In the embodiments disclosed herein, in addition, the ink is applied so as to form dots having an average diameter of R, and the opening (defined by the shape of the recessed portion viewed from above) of the recessed portions allows an imaginary circle having a diameter of less than R to be present therein. Consequently, the treatment liquid and the ink can be brought into contact with each other effectively, thus helping the formation of a high-quality intermediate image. If the imaginary circle allowed to be present within the opening 203 of the recessed portion has a diameter more than or equal to R, the intermediate transfer member will be exposed with an area larger than the ink dot size, even if the migration of the three-phase contact line is stopped at the edge of the opening 203. When ink dots are applied in a subsequent step, therefore, the ink dot deposited on the exposed region of the intermediate transfer member does not come into contact with the treatment liquid, and consequently, the resulting image does not have satisfactory quality.

The shape of the opening 203 of the recessed portion 201 may be in any shape, such as a circular, a polygonal, or a grip shape, and is not particularly limited. Although the section of the recessed portion 201 taken along the thickness direction of the intermediate transfer member may be rectangular, triangular, or domed, and may be in any shape, the depth D of the recessed portion 201 desirably satisfies $0.05\ \mu m \leq D \leq 5.0\ \mu m$. Recessed portions 201 having a depth D of 0.05 μm or more can hold the treatment liquid therein effectively and allow the treatment liquid to spread efficiently over the surface of the intermediate transfer member so as to form a coating film. Recessed portions 201 having a depth D of 5.0 μm or less allow the treatment liquid and ink having penetrated thereinto to be transferred effectively to a recording medium, thus contributing to improving image transfer efficiency. The depth D of a recessed portion 201 refers to the length from the surface of the intermediate transfer member adjacent to the recessed portion 201 to the position having the largest depth of the recessed portion 201. The intermediate transfer member satisfies the relationship $1.1 \leq S_2/S_1 \leq 5$. When $S_2/S_1$ is in this range, the intermediate transfer member allows the treatment liquid to spread over the surface thereof to form a coating film of the treatment liquid. Advantageously, the projected area $S_1$ and the actual surface area $S_2$ satisfy the relationship $1.1 \leq S_2/S_1 \leq 2.1$, desirably $1.15 \leq S_2/S_1 \leq 1.8$.

Figure 2A:
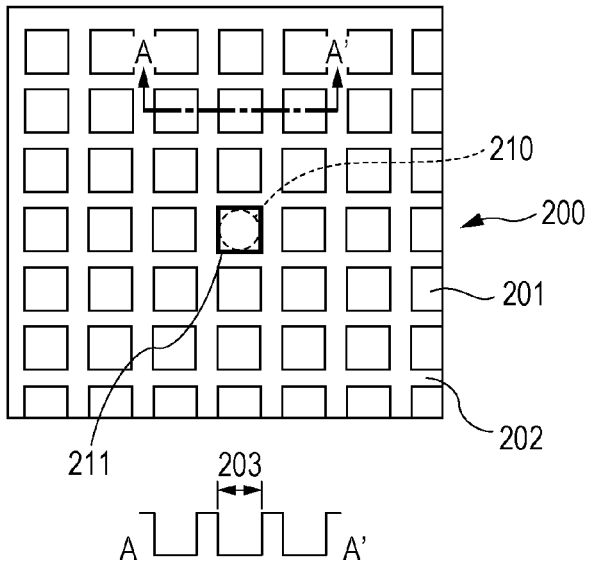
FIGS. 2A to 2D each depict a pattern of recessed portions formed in the surface of an intermediate transfer member according to an embodiment of the subject matter disclosed herein.
Figure 2B:
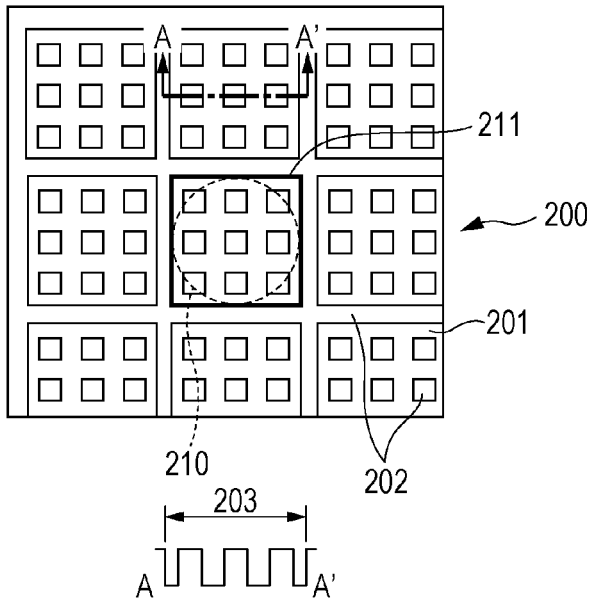
Figure 2C:
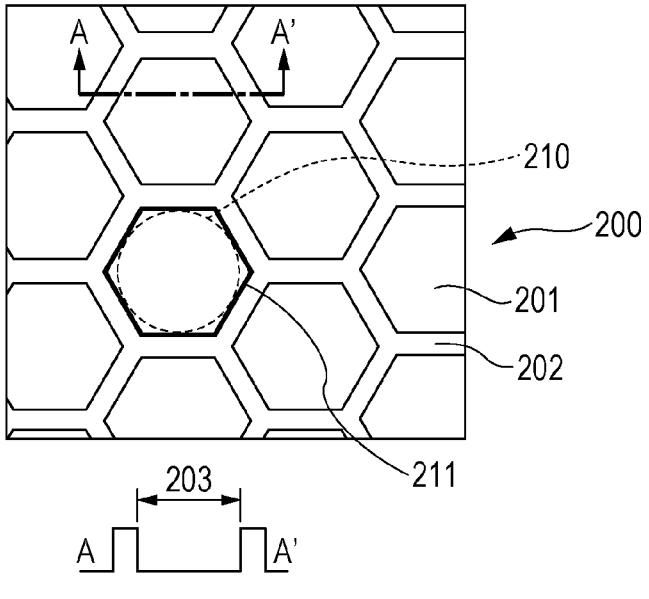
Figure 2D:
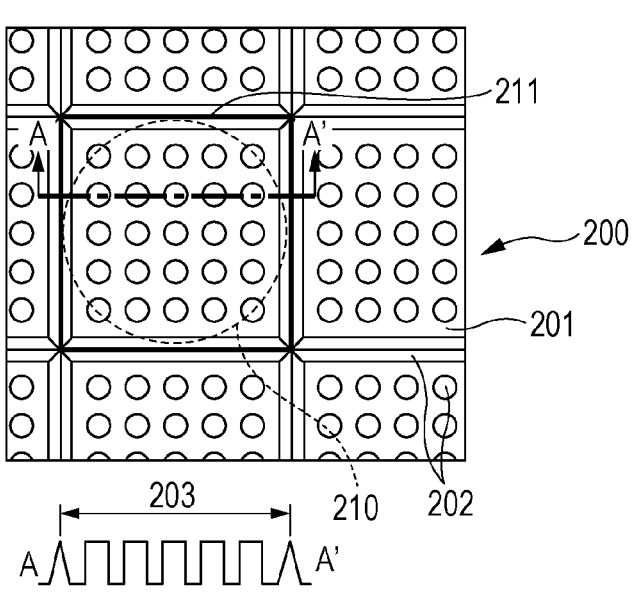

In the recessed portion 201, protruding members having various shapes may be arranged on the bottom or the side wall. For example, protruding portions extending to the level of the height of the opening 203 of the recessed portion 201 may be formed from the bottom of the recessed portion 201 in the opening 203 so that the upper end surfaces of the protruding portions 203 are arranged in an island manner in the opening 203, as shown in FIGS. 2B and 2D. The upper end surfaces of these protruding portions are flush with the surface 202 of the intermediate transfer member. When the upper end surface of the protruding portion separating and defining the recessed portions and the upper end surfaces of the protruding portions arranged in an island manner are substantially flush with each other, these upper end surfaces define the shape of the outermost surface that will receive the treatment liquid and the ink. The surface defined by those discontinuous upper end surfaces formed in the same plane has a shape that can act as the surface that will receive the treatment liquid and the ink for forming intermediate images. In the case shown in FIG. 1, for example, the protruding portions are formed so that the upper end surfaces thereof are flush with each other at least when they receive the treatment liquid and ink. If the intermediate transfer member is in a drum or roller form, the protruding portions are formed so that the upper end surfaces thereof are present in the same plane as the periphery defined by a rotation on the rotational axis of the drum- or roller-type intermediate transfer member.

In this instance, each portion surrounded by straight solid lines in plan view (in FIGS. 2B and 2D, portion 211 surrounded by solid bold lines) is defined as a single recessed portion 201. In the cases shown in FIGS. 2B and 2D, accordingly, circle 210 indicated by a dotted line is the imaginary circle allowed to be present within the recessed portion, and the diameter of this circle is less than R. When the recessed portion 201 is provided with surfaces 202 arranged in an island manner therein, more specifically, when each recessed portion 201 has a sea-island structure including the bottom thereof acting as the sea portion, and upper end surfaces of the protruding portions acting as island portions within the recessed portion, the three-phase contact line formed in the opening of the recessed portion 201 can be kept effectively from retreating. Consequently, a defect in the coating film can be prevented effectively from expanding. The upper end surfaces 202 of the protruding portions arranged in an island manner may have any shape without particular limitation and may be in a triangular shape or a circular shape. In particular, when the protruding portions extending from the bottom of the recessed portion 201 taper to sharp points, for example, in a conical shape or a quadrangular pyramid, the upper end surfaces 202 of the protruding portions arranged in an island manner form a dotted or linear pattern or the like.

The opening 203 of each recessed portion 201 separated from each other by the protruding portion, that is, each discrete recessed portion, desirably has an area (in plan view) of 2 $\mu m^2$ or more. In the case shown in FIGS. 2B and 2D, the area of the opening 203 of each recessed portion 201 is the area of the portion surrounded by the solid lines in plan view (portion 211 surrounded by solid bold lines) from which the area occupied by the surfaces of the island portions is subtracted. Hence, when surfaces of the island portions are present within the opening of the recessed portion, the area of the opening from which the area of the island portions are subtracted is desirably 2 $\mu m^2$ or more. When the area of the opening is 2 $\mu m^2$ or more, the treatment liquid applied to the surface of the intermediate transfer member can easily penetrate the recessed portions 201 and thus form an appropriate coating film of the treatment liquid.

The support member of the intermediate transfer member is required to have a strength to some extent from the viewpoint of conveyance accuracy and durability. Suitable materials of the support member include metals, ceramics and resins. Among these materials, advantageous are aluminum, iron, stainless steel, acetal resin, epoxy resin, polyimide, polyethylene, polyethylene terephthalate, nylon, polyurethane, silica ceramics, and alumina ceramics. These materials are suitable in view of the rigidity of the support member against pressure applied for transfer and the dimensional accuracy, and suitable to reduce the inertia in operation to improve control response. Two or more of these materials may be used in combination. The surface member of the intermediate transfer member may be made of a rubber elastic material, such as rubber or elastomer. These materials allow the surface of the intermediate transfer member to be elastically deformed by the pressure applied for transfer, and allows intermediate images to be transferred to the surface of various types of recording media. Also, from the viewpoint of the efficiency of image transfer from the intermediate transfer member to the recording medium, the material of the surface member desirably has a low surface free energy. Accordingly, the surface member (surface of the intermediate transfer member) may be formed of a compound having a dimethylsiloxane structure or a fluoroalkyl structure. Silicone rubber and fluorocarbon rubber can be an example of such an advantageous material. Alternatively, the surface member may be formed by forming some layers of different materials. For example, the surface made of a rubber may be coated with a material having a low surface free energy. More specifically, a urethane rubber member may be coated with a condensed material produced by condensation of a hydrolyzable organic silicon compound.

For forming fine recessed portions in the surface of the intermediate transfer member, sand blast, cutting, or press forming such as nanoimprinting may be applied. In particular, nanoimprinting enables the formation of uniform grooves having dimensions of the order of sub-micron to nanometers in a wide area, and is therefore advantageous. In a nanoimprinting process, desired recessed portions can be formed by pressing using a mold having a desired negative pattern of grooves having dimensions of the order of sub-micron to nanometers. For forming the mold, photolithography or etching is advantageous from the viewpoint of accuracy and facilitating the manufacturing process. In these techniques, the process conditions can be appropriately set according to the shape and dimensions of the recessed portion.

Treatment Liquid

The treatment liquid is intended to reduce the fluidity of the ink and may contain a substance for increasing the viscosity of the ink (hereinafter referred to as ink viscosity-increasing component) selected from known materials including, but not limited to, polyvalent metal ions, organic acids, cationic polymers, and porous particles without particular limitation. The ink viscosity-increasing component chemically reacts with or physically adsorbs to the coloring material or resin in the ink, thereby increasing the viscosity of the ink as a whole or forming an aggregate of some of the ink constituents. Thus, the viscosity of the ink is increased. Polyvalent metal ions and organic acids are particularly advantageous as the ink viscosity-increasing component. One or more of these ink viscosity-increasing components may be used in combination. The content of the ink viscosity-increasing component in the treatment liquid is desirably 5% by mass or more relative to the total mass of the treatment liquid.

More specifically, metal ions that can be used as the ink viscosity-increasing component include divalent metal ions and trivalent metal ions. Examples of divalent metal ions include $Ca^{2+}$, $Cu^{2+}$, $Ni^{2+}$, $Mg^{2+}$, $Sr^{2+}$, $Ba^{2+}$, and $Zn^{2+}$. Examples of trivalent metal ions include $Fe^{3+}$, $Cr^{3+}$, $Y^{3+}$, and $Al^{3+}$.

Examples of organic acids that can be used as the ink viscosity-increasing component include oxalic acid, polyacrylic acid, formic acid, acetic acid, propionic acid, glycolic acid, malonic acid, malic acid, maleic acid, ascorbic acid, levulinic acid, succinic acid, glutaric acid, glutamic acid, fumaric acid, citric acid, tartaric acid, lactic acid, pyrrolidonecarboxylic acid, pyronecarboxylic acid, pyrrolecarboxylic acid, furancarboxylic acid, pyridinecarboxylic acid, coumalic acid, thiophenecarboxylic acid, oxysuccinic acid, and dioxysuccinic acid.

The treatment liquid may contain an appropriate amount of water or organic solvent. The water is desirably deionized by, for example, ion exchange. The organic solvent that may be used in the treatment liquid is not particularly limited, and can be selected from known organic solvents. The treatment liquid may contain a resin. The addition of an appropriate resin to the treatment liquid is advantageous for increasing the adhesion of the transferred intermediate transfer member to the recording medium and for increasing the mechanical strength of the final image. Any resin may be added without particular limitation as long as it can coexist with the ink viscosity-increasing component. The treatment liquid may further contain a surfactant or a viscosity modifier to control the surface tension or the viscosity, if necessary. Any substance may be added without particular limitation as long as it can coexist with the ink viscosity-increasing component. For example, the surfactant may be selected from among cationic surfactants, anionic surfactants, nonionic surfactants, amphoteric surfactants, fluorochemical surfactants, and silicone surfactants. A mixture of two or more of these surfactants may be used. If the surface of the intermediate transfer member is made of a material having a low surface free energy such as fluorocarbon or silicone, a treatment liquid containing a fluorochemical or silicone surfactant is effective and advantageous in terms of transferability. The content of such a surfactant may be 0.1% by mass or more relative to the total mass of the treatment liquid from the viewpoint of sufficiently reducing the surface tension of the treatment liquid so that it can be retained in the recessed portions 101B of the intermediate transfer member 101. The treatment liquid may further contain fine particles. The fine particles may be, but are not limited to, resin particles or inorganic particles. The content of the fine particles may be 5% by mass or more relative to the total mass of the treatment liquid. Advantageously, the fine particles have a particle size allowing the particles to enter the recessed portions in the surface of the intermediate transfer member.

The viscosity of the treatment liquid is desirably 500 Pa·s or less. A treatment liquid having a viscosity of 500 Pa·s or less can easily fill the recessed portions and uniformly spread over a surface. The surface tension of the treatment liquid is desirably 40 mN/m or less. A treatment liquid having a surface tension of 40 mN/m or less can easily spread over a surface.

Ink

The ink may contain at least one of pigments and dyes as a coloring material. The coloring material can be selected from among the dyes and pigments generally used in inks without particular limitation, and a desired amount of the selected material can be used. For example, for an ink jet ink, a known dye, carbon black, an organic pigment, or the like may be used as the coloring material. A solution or dispersion of a dye and/or a pigment may be used as the ink. Pigments are advantageous as the coloring material in terms of the fastness and quality of printed articles. If a pigment is used, a known inorganic or organic pigment may be used without particular limitation. More specifically, pigments designated by color index (C.I.) numbers can be used. A carbon black may be used as a black pigment. The pigment content in the ink may be in the range of 0.5% by mass to 15.0% by mass, such as in the range of 1.0% by mass to 10.0% by mass, relative to the total mass of the ink.

A pigment dispersant may be used for dispersing the pigment. The pigment dispersant can be selected from among known materials used in the ink jet recording method. Among the known pigment dispersants, advantageous is a water-soluble dispersant having a molecular structure having both a hydrophilic site and a hydrophobic site. In particular, there may be used a pigment dispersant containing a resin produced by copolymerizing at least a hydrophilic monomer and a hydrophobic monomer. The monomers are not particularly limited, and any known monomers can be used. Examples of the hydrophobic monomer include styrene, styrene derivatives, alkyl (meth)acrylates, and benzyl (meth)acrylate. Examples of the hydrophilic monomer include acrylic acid, methacrylic acid, and maleic acid. The dispersant may have an acid value in the range of 50 mg KOH/g to 550 mg KOH/g. The weight average molecular weight of the dispersant may be in the range of 1,000 to 50,000. The mass ratio of the pigment to the dispersant may be in the range of 1:0.1 to 1:3. Instead of using a dispersant, a self-dispersible pigment that has been surface-modified so as to be dispersible may be used.

The ink may further contain fine particles not containing a coloring material. Since some types of resin fine particles have the effect of improving image quality and adhesion, resin fine particles are advantageous. The material of the resin fine particles can be selected from among known resins without particular limitation. Exemplary materials of the resin fine particles include homopolymers or copolymers, such as polyolefin, polystyrene, polyurethane, polyester, polyether, polyurea, polyamide, polyvinyl alcohol, poly (meth)acrylic acids and salts thereof, polyalkyl (meth)acrylates, and polydiens. The weight average molecular weight of the resin fine particles may be in the range of 1,000 to 2,000,000. The content of the resin fine particles in the ink may be in the range of 1% by mass to 50% by mass, such as in the range of 2% by mass to 40% by mass, relative to the total mass of the ink. The ink may be used in the form of a resin fine particle dispersion in which resin fine particles are dispersed. The resin fine particles may be dispersed by any process. For example, particles of a homopolymer or copolymer of one or more monomers having a dissociable group are dispersed, and a thus prepared dispersion of self-dispersible resin particles is advantageously used. Exemplary dissociable groups include carboxy, sulfo and phosphate groups, and monomers having such a dissociable group include acrylic acid and methacrylic acid. Alternatively, an emulsifier-dispersed resin particle dispersion may be used which is prepared by dispersing resin fine particles with an emulsifier. A known surfactant may be used as the emulsifier irrespective of whether the resin particles have a low molecular weight or a high molecular weight. A non-ionic surfactant or a surfactant having the same polarity as the resin fine particles is advantageous as the surfactant. The resin particles in the resin fine particle dispersion may have a particle size in the range of 10 nm to 1000 nm, such as 100 nm to 500 nm. For preparing the resin fine particle dispersion, some additives may be added to stabilize the dispersion. Examples of the additives include n-hexadecane, dodecyl methacrylate, stearyl methacrylate, chlorobenzene, dodecyl mercaptan, olive oil, blue dye (Blue 70), and polymethyl methacrylate.

The ink may contain a surfactant. The surfactant may be Acetylenol EH (produced by Kawaken Fine Chemicals). The surfactant content in the ink may be in the range of 0.01% by mass to 5.0% by mass relative to the total mass of the ink. The ink may also contain water and/or a water-soluble organic solvent as the solvent. The water is desirably deionized by ion exchange. The water content in the ink can be in the range of 30% by mass to 97% by mass relative to the total mass of the ink. The water-soluble organic solvent is not particularly limited and any known organic solvent may be used. Examples of the water-soluble organic solvent include glycerin, diethylene glycol, polyethylene glycol, and 2-pyrrolidone. The content of the water-soluble organic solvent in the ink may be in the range of 3% by mass to 70% by mass relative to the total mass of the ink. The ink used in the present embodiment may further contain other additives, such as a pH adjuster, a rust preventive, a preservative, a fungicide, an antioxidant, an antireductant, a water-soluble resin and its neutralizer, and a viscosity modifier, as needed.

EXAMPLES

The image forming method and intermediate transfer member according to an embodiment of the disclosure will be further described with reference to Examples. The scope of the disclosure is not limited to the following Examples. In the following description, "part(s)" and "%" are on a mass basis unless otherwise specified.

Preparation of Intermediate Transfer Member

One of the intermediate transfer members used in the Examples and Comparative Examples was prepared as below. First, a silicon substrate was formed into a mold for forming the intermediate transfer member by photolithography and etching. Subsequently, the mold was dipped in a release agent Durasurf HD-1101 TH (product name) produced by Harves. Then, the mold was allowed to stand at room temperature for 24 hours and rinsed with Novec HFE-7100 (product name) produced by 3M to remove the excess release agent. Subsequently, a silicone rubber SIM-260 (product name) produced by Shin-Etsu Chemical, which is a compound having a dimethylsiloxane structure and a curing agent CAT-260 (product name) by Shin-Etsu Chemical were mixed and kneaded in a mass ratio of 10 to 1, and the mixture was applied to a polyimide film to form a silicone rubber layer. Then, the silicon mold was pressed against the silicone rubber and heated at 150° C. for 30 minutes to cure the silicone rubber. Then, the mold was removed to yield an intermediate transfer member having small recessed portions in the surface thereof.

Figure 3A:
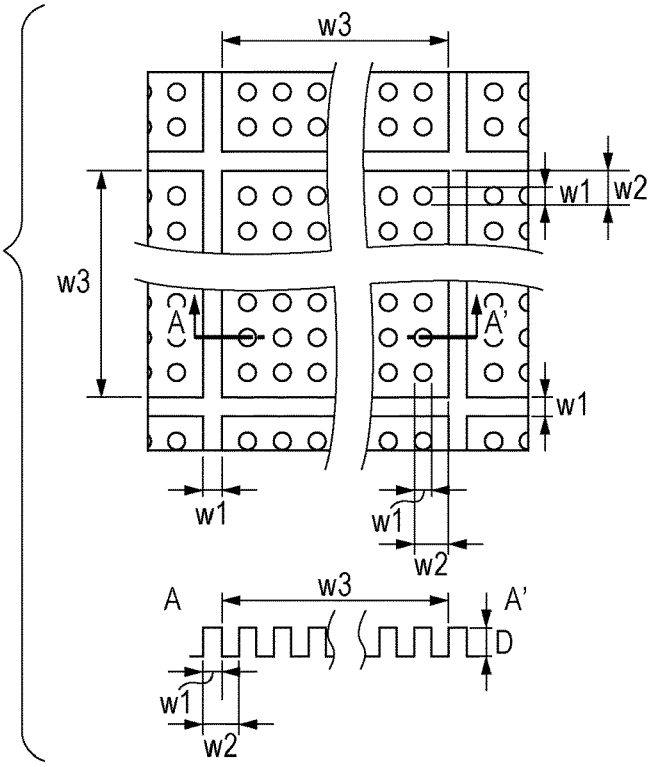
FIGS. 3A and 3B are illustrative representations of intermediate transfer members used in Examples and Comparative Examples of the subject matter disclosed herein.
Figure 3B:
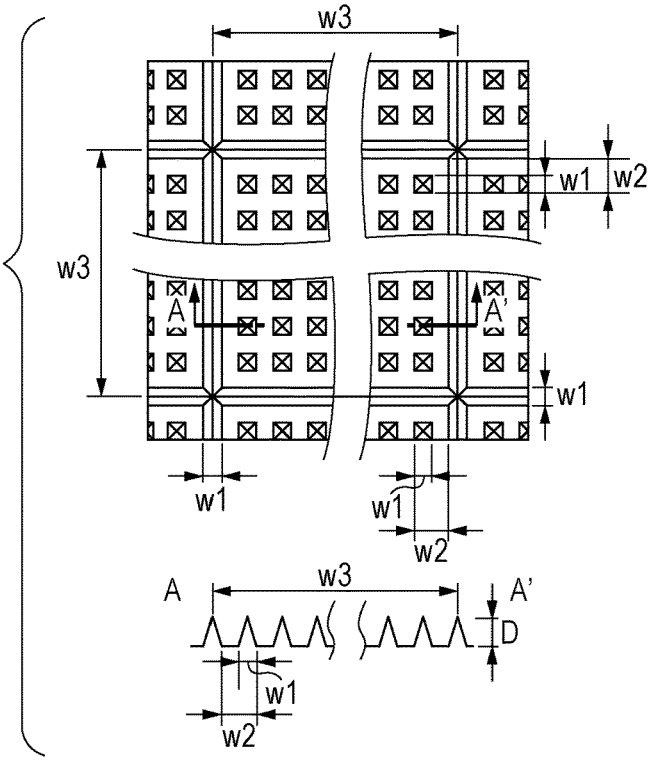

The surface and section of the resulting intermediate transfer member were observed through a scanning electron microscope and an atomic force microscope for measuring the shape and dimensions of the recessed portions. The section of the intermediate transfer member was formed by cutting the intermediate transfer member. As a result, it was found that recessed portions were formed in a grid manner throughout the surface as shown in FIG. 2B. Each recessed portion had a rectangular section as shown in FIG. 3A, with widths: w1=2.0 μm, w2=4.0 μm, and w3=26 μm; and a depth D=0.4 μm. The $S_2/S_1$ ratio was 1.16. This sample was examined as intermediate transfer member 1. In addition, intermediate transfer members 2 to 7 (Examples 2 to 5 and Comparative Examples 1 and 2) shown in Table 1 were prepared in the same manner as intermediate transfer member 1 except that the shape and/or dimensions of the mold were varied. Furthermore, intermediate transfer member 8 (Example 6) was prepared in the same manner except that the mixture of the silicone rubber SIM-260 produced by Shin-Etsu Chemical and the curing agent CAT-260 by Shin-Etsu Chemical was replaced with a mixture in a mass ratio of 1 to 1 of fluorine-containing elastomers SIFEL 3045A and SIFEL 3045B produced by Shin-Etsu Chemical having a fluoroalkyl structure. Shapes (A) and (B) shown in Table 1 represent those shown in FIGS. 3A and 3B, respectively. Also, w1, w2, w3 and D shown in Table 1 represent the corresponding dimensions shown in FIGS. 3A and 3B. The "area of opening" in Table 1 was calculated by (w3×w3)−(area of island portions). The openings of the recessed portions shown in FIGS. 3A and 3B are square in plan view. Hence, the diameter of the circle that can be present within the recessed portion is equal to w3.

TABLE 1

| | | Shape | w1 [μm] | w2 [μm] | w3 [μm] | D [μm] | Area of opening [μm²] | $S_2/S_1$ |
|---|---|---|---|---|---|---|---|---|
| Example 1 | Intermediate transfer member 1 | (A) | 2.0 | 4.0 | 26 | 0.4 | 652 | 1.16 |
| Example 2 | Intermediate transfer member 2 | (A) | 0.4 | 0.8 | 6.0 | 0.4 | 29.8 | 1.79 |
| Example 3 | Intermediate transfer member 3 | (B) | 1.0 | 2.0 | 27 | 0.71 | 729 | 1.21 |
| Example 4 | Intermediate transfer member 4 | (A) | 0.4 | 0.8 | 6.0 | 0.04 | 298 | 1.10 |
| Example 5 | Intermediate transfer member 5 | (A) | 0.3 | 0.6 | 1.5 | 0.3 | 1.97 | 2.05 |
| Comparative Example 1 | Intermediate transfer member 6 | (A) | 2.0 | 4.0 | 42 | 0.4 | 1450 | 1.16 |
| Comparative Example 2 | Intermediate transfer member 7 | (A) | 2.0 | 4.0 | 26 | 0.2 | 652 | 1.08 |
| Example 6 | Intermediate transfer member 8 | (A) | 2.0 | 4.0 | 26 | 0.4 | 652 | 1.16 |

Preparation of Treatment Liquid

Two mixtures were prepared according to the compositions shown in Table 2. Then, the two mixtures were each heated in an oven at 50° C. for 24 hours to remove water, thus yielding treatment liquids A and B from which water was removed.

TABLE 2

| | Treatment liquid A | Treatment liquid B |
|---|---|---|
| Levulinic acid | 45 parts | 45 parts |
| Potassium hydroxide | 3 parts | 3 parts |
| Fluorochemical surfactant MEGAFAC F-444 (DIC) | 10 parts | 1 part |
| Resin particles AQUACER 531 (BYK) | 20 parts | 20 parts |
| Ion exchanged water | 22 parts | 30 parts |

Preparation of Inks

Inks were prepared according to the compositions shown in Table 3.

TABLE 3

| Pigments | |
|---|---|
| Black: carbon black (MCF 88 produced by Mitsubishi Chemical) | |
| Cyan: Pigment Blue 15 | 3 parts |
| Magenta: Pigment Red 7 | |
| Yellow: Pigment Yellow 74 | |
| Styrene-acrylic acid-ethyl acrylate copolymer | 1 part |
| Glycerin | 10 parts |
| Ethylene glycol | 5 parts |
| Surfactant | |
| Acetylenol EH (Kawaken Fine Chemicals) | 1 part |
| Ion exchanged water | 80 parts |

Image Forming Method

The following steps (a) to (c) for forming images were performed, using the above-prepared intermediate transfer members, treatment liquids for reducing ink fluidity, and inks.

(a) Step of Applying Treatment Liquid Onto Intermediate Transfer Member

The treatment liquid was applied to the surface of the intermediate transfer member with a roll coater. The treatment liquid was applied at a rate of 1.0 g/m$^2$.

(b) Step of Forming Intermediate Image on Intermediate Transfer Member

Using an ink jet recording apparatus (nozzle density: 1200 dpi; ejection amount: 4.8 pL; driving frequency: 12 kHz), a mirror-reverse characters (intermediate image) were formed by applying inks onto the intermediate transfer member coated with the treatment liquid. The average diameter R of the ink dots applied on the intermediate transfer member was measured through an optical microscope, and it was 30 μm. The average diameter R of the ink dots was calculated by averaging the measured diameters of the ink dots at 25 points randomly selected from a square region of 500 μm on a side observed through the optical microscope.

(c) Step of Transferring Intermediate Image to Recording Medium

The liquid component in the intermediate image was reduced by blowing hot air from a dryer on the intermediate image on the intermediate transfer member. Then, the intermediate transfer member was heated to 70° C. on a hot plate, and the intermediate image on the intermediate transfer member and a recording medium were pressed on each other at 1.0 MPa with a pressure roller. The recording medium was Aurora Coat manufactured by Nippon Paper Industries.

The intermediate transfer members and the treatment liquids were combined as shown in Table 4. The resulting images were evaluated as below. The evaluation results are shown in Table 4.

Evaluations (1) State of Treatment Liquid Coating Film

The surface of each intermediate transfer member subjected to Step (a) was observed through an optical microscope. The area of the portions of the intermediate transfer member exposed by repelling of the treatment liquid and allowing a circle with a diameter of 30 μm or more to be present therein was measured, and the percentage of this area to the projected area of the intermediate transfer member was calculated.

(2) Images

Images obtained through Step (c) were evaluated according to the following criteria.

Good: Color unevenness resulting from unintended migration of ink dots or attraction among ink dots was hardly observed.

Bad: A large amount of color unevenness resulting from unintended migration of ink dots or attraction among ink dots was observed.

TABLE 4

| | Intermediate transfer member | Treatment liquid | State of coating film [%] | Image evaluation |
|---|---|---|---|---|
| Example 1 | Intermediate transfer member 1 | Treatment liquid A | 0 | Good |
| | | Treatment liquid B | 5 | Good |
| Example 2 | Intermediate transfer member 2 | Treatment liquid A | 0 | Good |
| | | Treatment liquid B | 0 | Good |
| Example 3 | Intermediate transfer member 3 | Treatment liquid A | 0 | Good |
| | | Treatment liquid B | 8 | Good |
| Example 4 | Intermediate transfer member 4 | Treatment liquid A | 12 | Good |
| | | Treatment liquid B | 90 | Bad |
| Example 5 | Intermediate transfer member 5 | Treatment liquid A | 9 | Good |
| | | Treatment liquid B | 92 | Bad |
| Comparative Example 1 | Intermediate transfer member 6 | Treatment liquid A | 27 | Bad |
| | | Treatment liquid B | 58 | Bad |
| Comparative Example 2 | Intermediate transfer member 7 | Treatment liquid A | 64 | Bad |
| | | Treatment liquid B | 88 | Bad |
| Example 6 | Intermediate transfer member 8 | Treatment liquid A | 7 | Good |
| | | Treatment liquid B | 15 | Good |

The results clearly show that an embodiment of the disclosure enables the formation of high-quality images having little color unevenness.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

The present application is a continuation of U.S. patent application Ser. No. 14/932,808 filed on Nov. 4, 2015, which claims priority from Japanese Patent Application No. 2014-226065, filed Nov. 6, 2014, which is hereby incorporated by reference herein in its entirety.

What is claimed is:

1. An intermediate transfer member for an ink jet recording apparatus, comprising:

a surface capable of receiving an ink, the surface having a plurality of recessed portions having bottoms, each recessed portion allowing a circle having a diameter of less than an average diameter R of ink dots on the intermediate transfer member, and wherein the surface has a sea-island structure in plain view including sea portions defined by the bottoms of the recessed portions and island portions defined by the upper end surfaces of protruding portions disposed within the recessed portions.

2. The intermediate transfer member according to claim 1, wherein the recessed portions each have an area of 2 $\mu m^2$ or more when viewed from above.

3. The intermediate transfer member according to claim 1, wherein the recessed portions each have a depth of D satisfying the relationship $0.05\ \mu m \leq D \leq 5.0\ \mu m$.

4. The intermediate transfer member according to claim 1, wherein the surface of the intermediate transfer member contains a compound having one of a dimethyl siloxane structure and a fluoroalkyl structure.

5. The intermediate transfer member according to claim 1, wherein a shape of an opening of the recessed portion is a circular, polygonal, or grid.

6. The intermediate transfer member according to claim 1, wherein a shape of a section of the recessed portion is rectangular, triangular, or domed.

7. The intermediate transfer member according to claim 1, wherein the protruding portions are formed in a bottom of the recessed portion.

8. An image forming method comprising:

forming an intermediate image by applying an ink onto an intermediate transfer member according to claim 1 so as to form ink dots having an average diameter of R; and transferring the intermediate image to a recording medium.

9. An image forming apparatus comprising:

an intermediate transfer member according to claim 1;

an ink jet recording head; and a pressure roller for transferring an intermediate image on the intermediate transfer member to a recording medium.

* * * * *